US011628964B2

(12) United States Patent
Owens et al.

(10) Patent No.: US 11,628,964 B2
(45) Date of Patent: Apr. 18, 2023

(54) LIQUID DETECTION VACUUM

(71) Applicant: Sunbeam Products, Inc., Boca Raton, FL (US)

(72) Inventors: David Owens, Boynton Beach, FL (US); Chan Wing Cheuk, Kowloon Bay (HK); Poon Chi Kwong, Wong Chuk Hang (HK)

(73) Assignee: Sunbeam Products, Inc., Boca Raton, FL (US)

( * ) Notice: Subject to any disclaimer, the term of this patent is extended or adjusted under 35 U.S.C. 154(b) by 2 days.

(21) Appl. No.: 17/231,459

(22) Filed: Apr. 15, 2021

(65) Prior Publication Data

US 2021/0323708 A1 Oct. 21, 2021

Related U.S. Application Data

(60) Provisional application No. 63/010,134, filed on Apr. 15, 2020.

(51) Int. Cl.
*B65B 57/00* (2006.01)
*B65B 31/04* (2006.01)

(52) U.S. Cl.
CPC ..... *B65B 57/00* (2013.01); *B65B 31/048* (2013.01)

(58) Field of Classification Search
CPC ..... B65B 57/00; B65B 31/048
See application file for complete search history.

(56) References Cited

U.S. PATENT DOCUMENTS

2005/0050860 A1* 3/2005 Sung ..... B65B 31/046 53/512
2005/0223682 A1* 10/2005 Sung ..... B65B 31/046 53/512
2018/0162569 A1* 6/2018 Day ..... B65B 25/001

* cited by examiner

*Primary Examiner* — Thomas M Wittenschlaeger
(74) *Attorney, Agent, or Firm* — Husch Blackwell LLP

(57) ABSTRACT

An appliance is provided that is able to vacuum and heat seal plastic bag members containing liquids such as sauces and soups. The appliance may take on a uniquely shaped profile to allow the liquid to sit upright within a bag during the vacuuming process. The appliance also preferably includes a pressure sensor to constantly monitor pressure inside of the bag during the vacuum and sealing process. This may help to prevent liquid from being sucked up and into the appliance.

14 Claims, 5 Drawing Sheets

LIQUID DETECTION VACUUM

CROSS-REFERENCE TO RELATED APPLICATIONS

This Application claims priority to U.S. Provisional Patent Application Ser. No. 63/010,134, filed on Apr. 15, 2020, entitled "LIQUID DETECTION VACUUM", the entire disclosure of which is incorporated herein by reference.

FIELD OF THE INVENTION

The present invention relates generally to food storage. More particularly, it relates to a vacuum packaging and sealing appliance that is configured to create a vacuum in a food storage bag and subsequently seal the top of the bag. Food products may then be stored within the bag in a freezer, refrigerator, pantry or other food storage area under vacuum until ready for use. The vacuum sealed bag allows the food products to be stored in the bag for longer periods of time.

BACKGROUND OF THE INVENTION

Storing food, vegetables, herbs, preparation ingredients and leftovers is common practice. Often these products are stored in ordinary food storage bags which can be closed using an interlocking seal or zipper closure, and then placed in freezers, refrigerators, pantries and other storage locations. Over longer periods of time, food stored in ordinary food storage bags will spoil, waste, or become unusable and will have to be thrown away. Vacuum sealing food products within a bag has been known to extend the freshness and useful life of food products stored, thereby reducing food waste and spoilage.

An example prior art vacuum packaging and sealing appliance 1, hereinafter referred to as appliance 1, is shown in FIG. 1. The appliance 1 is shown receiving a sealable bag member 5 with a food product 10 contained therein. One end portion 15 of the bag member 5 is already sealed, but its opposite end portion 20, which includes top and bottom side edge portions 25, 30, remains open and unsealed so that food products can be stored within the bag member 5.

An opening 35 in the appliance 1 preferably receives the open end portion 20 of the bag member 5 so that it may be vacuumed and sealed. The opening 35 associated with a typical vacuum appliance such as the appliance 1 is located on the front wall of the appliance, which is positioned and located substantially perpendicular to the supporting surface on which it rests. In order for the appliance 1 to pull a vacuum in the bag member 5, the top and bottom side edge portions of the open end of the bag must be inserted into a drip tray 40 for proper positioning within the vacuum chamber of the appliance.

If both edge portions of the open end of the bag are not positioned over a heater bar 45 as illustrated in FIG. 1, the bag member 5 will not be properly vacuum sealed. The open end of the bag would not be in connection with the heater bar once the appliance was closed, thereby preventing a proper seal. The appliance 1 subsequently applies heat via the heating bar 45 located at a front portion 50 of the appliance 1 to seal the open end portion 20 of the bag member 5.

Such prior art appliances 1 work well to vacuum seal solid food products. Currently, however, there is not a way to automate vacuum sealing a liquid such as a soup or sauce in a flexible bag using a commonly available vacuum sealer appliance such as the appliance 1. The appliance 1 would suck most if not all of the liquid out of the bag. This not only makes a mess, but also hinders the appliance 1 in making a secure heat seal.

It is therefore desirable to provide a vacuum packaging and sealing appliance that can vacuum seal liquids such as soups and sauces in a flexible vacuum seal bag without sucking all or a portion of the contents out.

SUMMARY OF THE INVENTION

The present invention, like the prior art appliance 1, is an appliance that vacuums and seals plastic bag members containing a food product. Unlike the appliance 1, however, the appliance of the current invention may vacuum and seal liquids such as sauces and soups. The appliance may or may not take on a uniquely shaped profile to allow the liquid to sit upright within a bag (and not on its side, where it could spill out) during the vacuuming process. Such a profile may relate to an upper portion of the appliance's housing facing upwardly and away from the base of the housing. In such a configuration the upper portion is preferably curved relative to the housing.

Furthermore, the invention may use a pressure sensor (instead of a mechanical pressure switch) to constantly monitor pressure inside of the bag. When a negative vacuum pressure is detected by the sensor, a microprocessor could control the vacuum pump to stop or slow the vacuum process and subsequently allow a slight amount of vacuum to be released to stop the progress of the liquid up the bag. In some embodiments, this process may be repeated multiple times, or it may be altered to perform well with liquids of varying thicknesses or for other types of foodstuffs. The appliance may then begin its heat seal operation.

The appliance allows users to vacuum seal liquids such as soups and sauces without the need to pre-freeze before vacuuming, or try to manually stop the machine before it makes a mess. Further, it helps to prevent liquids from being sucked out of the bag during the vacuum and sealing process.

The invention can have as many settings as necessary or desired for different types of food or liquids. For example, the pressure sensor circuit can also be used to program and preset buttons for breads or other food and non-foodstuffs needing a gentler vacuum.

BRIEF DESCRIPTION OF THE DRAWINGS

For a better understanding of the present invention, reference may be made to the following accompanying drawings.

DETAILED DESCRIPTION OF THE INVENTION

Figure 2:
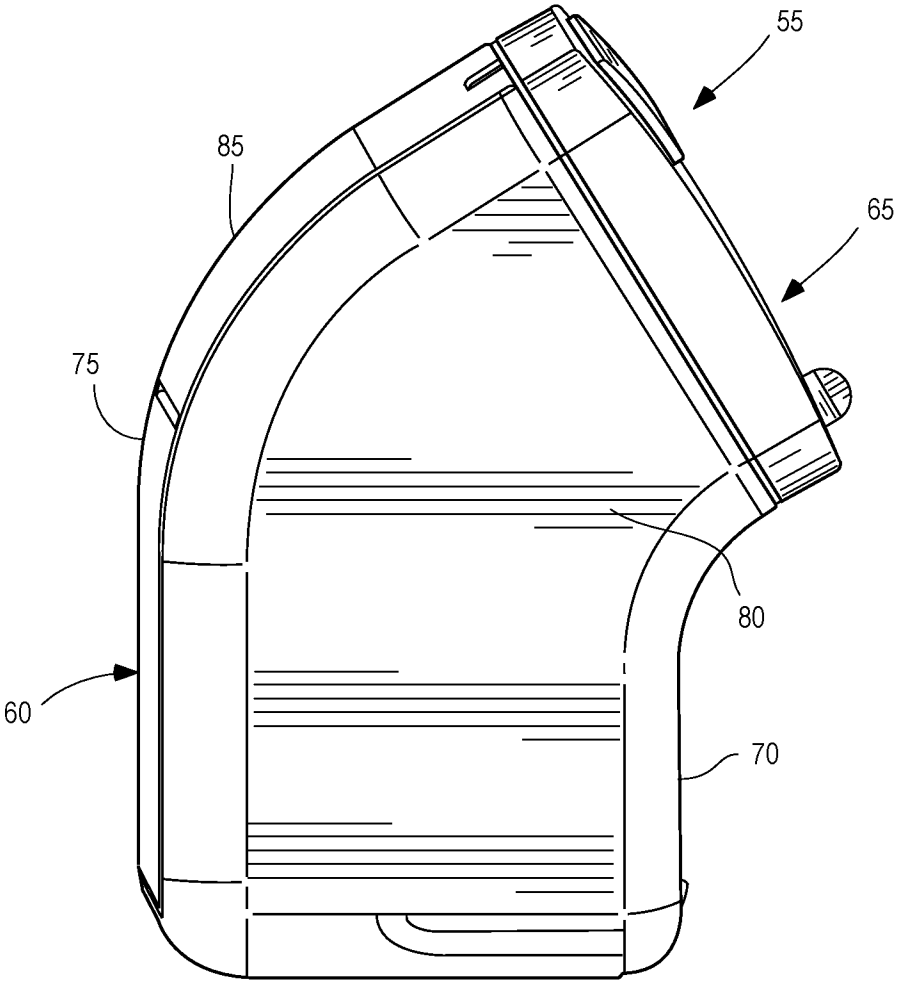
FIG. 2 is a side elevation view of a vacuum packaging and sealing appliance constructed according to the teachings of the present invention.
Figure 3:
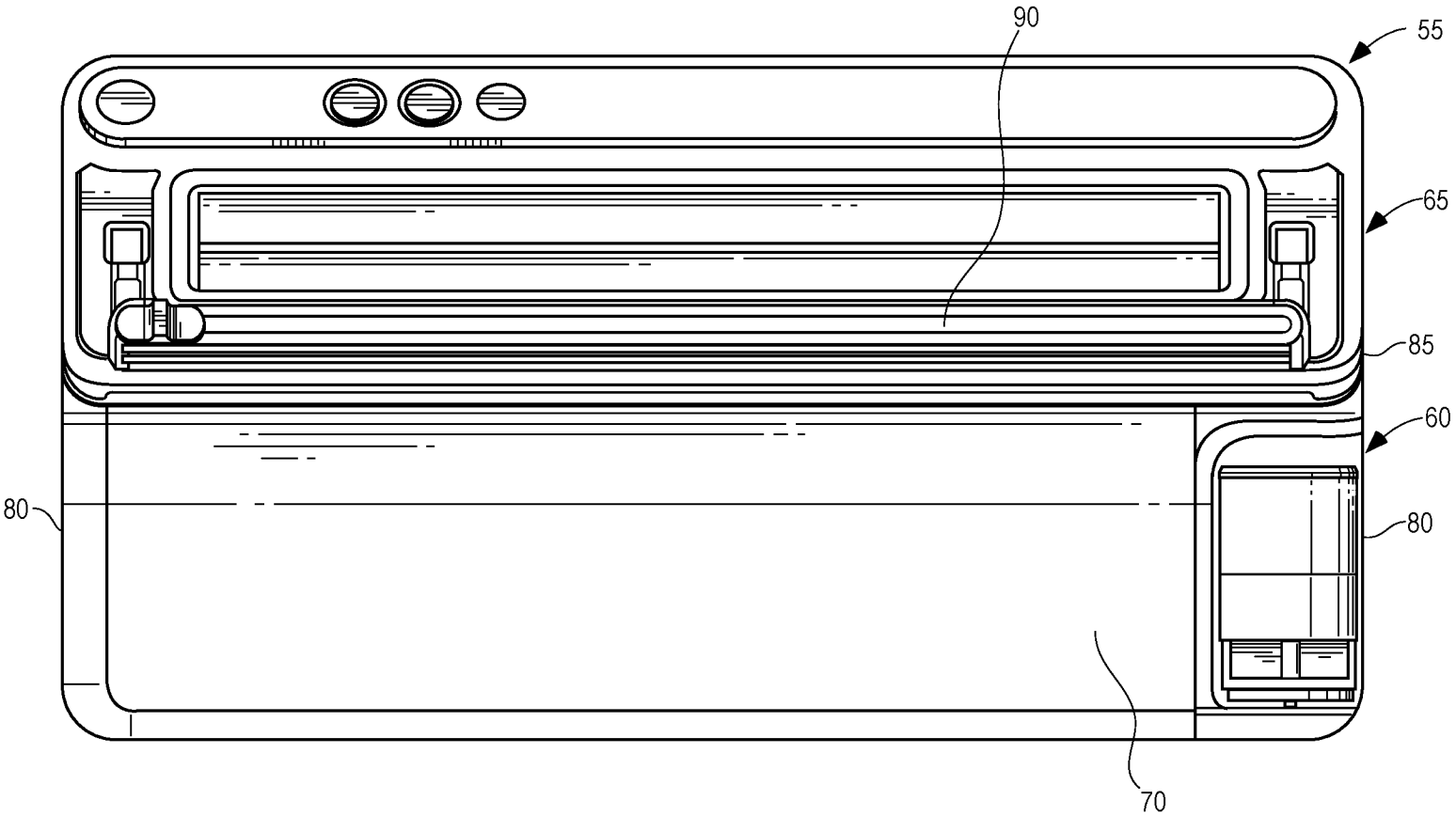
FIG. 3 is a front elevation view of the vacuum packaging and sealing appliance of FIG. 2.

Turning to FIGS. 2 and 3, an improved vacuum packaging and sealing appliance 55, hereinafter referred to simply as appliance 55, is provided. The appliance 55, like the prior art appliance 1, preferably includes a base portion 60 and a lid portion 65. The lid portion 65 and the base portion 60 are preferably hingedly attached to one another so that the lid portion 65 may be opened upwardly away from the base portion 60 to insert a bag therein.

The base portion 60 is enclosed by a front wall 70, rear wall 75, and side walls 80 to define, with the lid portion 65, a housing of the appliance 55. As illustrated in FIGS. 2 and 3, at an upper portion 85 of the base portion 60, the appliance 55 may project upwardly and outwardly from the base portion 60. Put another way, the upper portion 85 is curved forwardly such that the front wall 70 is curved forwardly as the front wall 70 extends from upwardly from the bottom of the appliance 55. In doing so, at least a portion of the lid portion 65 is positioned in front of either of the side walls 80 and the bottom of the base portion 60.

Figure 1:
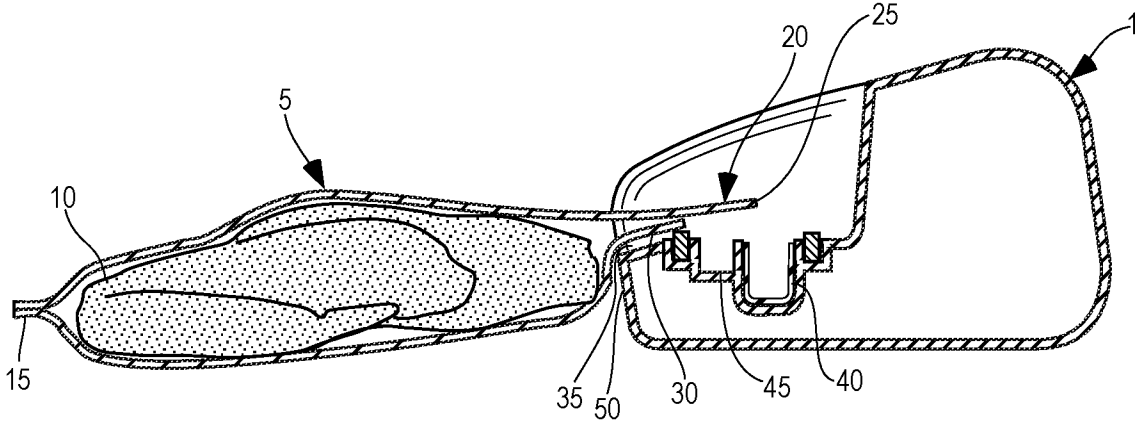
FIG. 1 PRIOR ART
FIG. 1 is a cross-sectional view of a prior art vacuum packaging and sealing appliance and a bag member containing a food product being inserted into the prior art appliance to be vacuumed and sealed.

The lid portion 65 similarly projects upwardly and outwardly from the base portion 60. An opening 90 (illustrated in FIG. 3) in the lid portion 65 therefore faces at least partially upwardly and outwardly to receive a bag (such as the bag member 5 in FIG. 1) within the opening 90 while the bag is largely in an upright position. The bag is therefore not on its side like in prior art vacuuming and sealing appliances such as the appliance 1 of FIG. 1. This reduces the likelihood that contents within a bag spill or otherwise fall out of the bag, preventing messes. Because the vacuum and sealing appliance 55 described herein may be used with liquids such as soups or sauces, such contents are particularly susceptible to spilling out of a bag.

Figure 4:
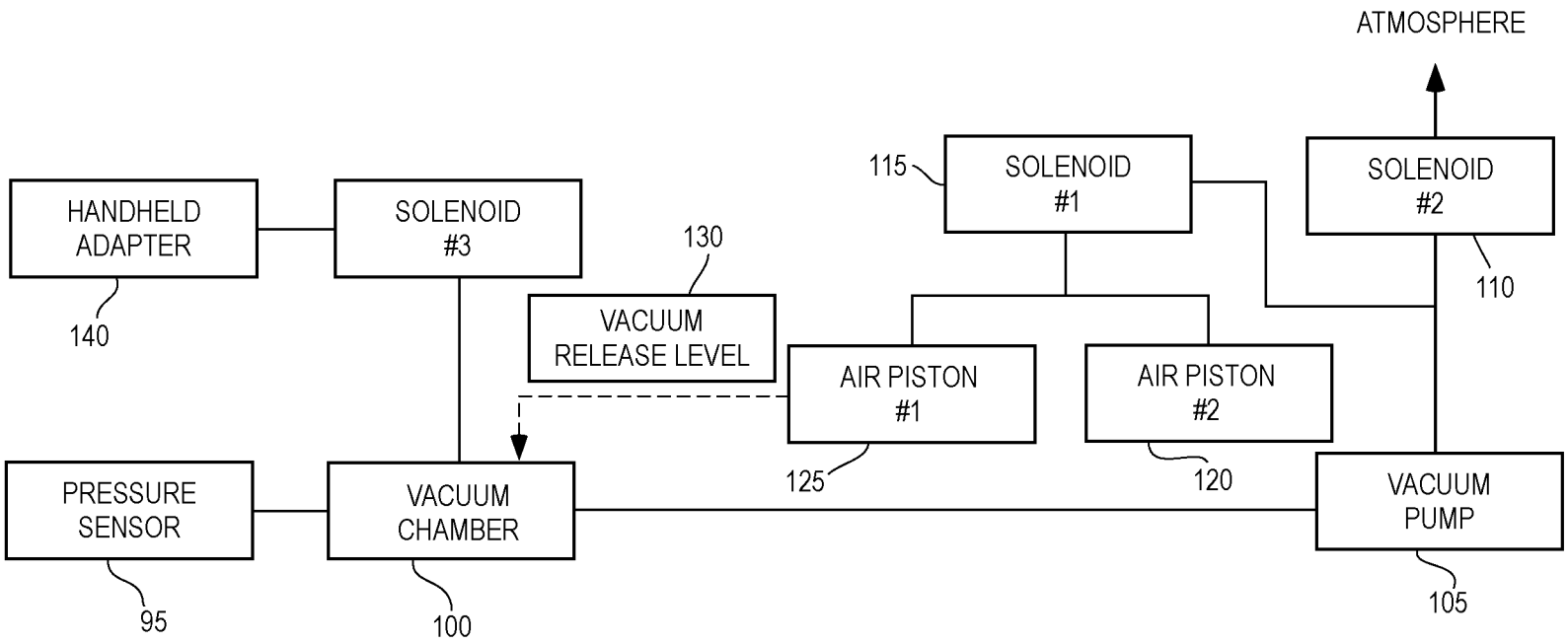
FIG. 4 is a diagram showing an embodiment of various components that make up the vacuum packaging and sealing appliance of FIGS. 2 and 3.

Turning to FIG. 4, a block diagram is provided that details one possible embodiment of the appliance 55 and the manner in which it may function. Instead of an electromechanical pressure switch such as those used in the prior art that instructs a vacuum to shut off upon reaching a particular pressure, the appliance 55 uses a pressure sensor 95. The pressure sensor 95 is preferably in communication with a vacuum chamber 100. As can be appreciated by those skilled in the art, the pressure sensor 95 preferably operates using an analog voltage output. As pressure decreases when the appliance 55 is turned on and used in a manner substantially similar to the appliance 1, the output voltage will change accordingly. A microprocessor in communication with the appliance 55 could include an analog to digital converter, and may use a lookup table that relates voltages to pressures. When certain pressures are reached, the microprocessor preferably instructs a vacuum pump 105, which is in communication with the vacuum chamber 100 to stop or slow down pumping, as set forth below in example embodiments.

Further, as those skilled in the art may recognize, solenoids 110, 115, may work to regulate pressures of the vacuum generated by the vacuum pump 105 and air pistons 120, 125 may help close a door on the housing and clamp the bag. A manually operated door to close the housing may also work. The solenoid 110 may be in communication with atmosphere to release certain pressures when instructed to do so. Further, a vacuum release lever 130 may be provided that is able to work with the pistons 120, 125 to release pressure from the vacuum chamber 100 when instructed to do so by the microprocessor. An additional solenoid 135 may also be provided in some embodiments. Such embodiments use a handheld adaptor 140 to assist with the vacuum process. Such handheld adaptors 140 are well known and understood in the art.

Figure 5:
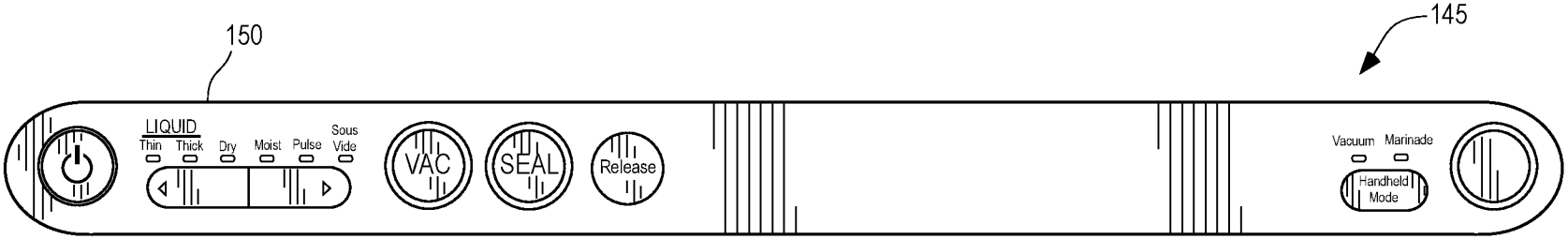
FIG. 5 is a plan view of a control panel of the vacuum packaging and sealing appliance of FIGS. 2 and 3.

FIG. 5 illustrates an example control panel 145 of the lid member 65. The control panel 145 may include a nearly limitless number of settings. In some embodiments such as those described herein, the control panel 145 includes at least a liquid mode 150 that includes settings for each of a thin and thick liquid. Such settings may be tailored to certain operations, and they may further assist with improving the vacuuming process, for example by helping to remove bubbles form the bag where the liquids may be stored. In operation, the thin and thick liquid settings of the pressure sensor may have different vacuum level thresholds.

For example, when the thin liquid setting is activated, when a certain pressure level is reached, the microprocessor may instruct the vacuum pump 105 to slow down its pump speed. This occurs during active pressure monitoring based on certain pressure limits. As pressure continues to decrease, the pump 105 may be stopped. At that time, in at least one embodiment, the solenoid 110 may be opened for a preset (or non-preset) period of time so as to slow and/or stop liquid in the bag from proceeding any farther up the vertical walls of the bag. This may occur to allow any residual pressure from within the bag to even itself out before the liquid is drawn up from the bag and into the appliance 55. This may also help to remove bubbles from within the liquid. Subsequently, a heat seal process substantially like the heat seal process described for the appliance 1 may begin. The heat seal process may be for a longer period of time than the process described above to seal through any residual moisture pulled across the heat seal area.

As a non-limiting example, the method used for a thin liquid may be similar for a different foodstuff such as bread. However, in that setting (which may have a button, switch, or other "activation element" on the control panel 145), the trigger for the pressure sensor 95 may be different.

In another example, a thick liquid setting may be used that is controlled by a button, switch, or the like on the control panel 145. In such a setting, the vacuum pump 105 may first be instructed to operate slowly. The pressure sensor 95 may then actively monitor for preset pressured limits. Once such pressure limits are met, the vacuum pump 105 may be stopped, and the solenoid 110 may be opened to reduce pressure in the appliance 55. Unlike in the thin liquid vacuum process, the pump 105 may then operate at a high speed. At this time, the pressure sensor 95 may also work to monitor pressures for preset limits. After a preset time, the pump 105 may again turn off before turning back on at a slow speed. Again, the pressure may be monitored by the pressure sensor 95 during this process. The solenoid 110 may then be opened for a preset amount of time once again. Next, the heat seal process substantially similar to that used with the appliance 1 may begin.

As one skilled in the art may appreciate, the settings for vacuuming may vary for different foodstuffs. Because the appliance 55 includes the pressure sensor 95, nearly any possible process for vacuuming may be used, and thus the appliance 55 may function to vacuum and store not only thick and thin liquids, but other foodstuffs.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations.

Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. An appliance for vacuum sealing a bag member having a closed bottom portion and an open top portion, the appliance comprising:

a housing including a front wall member, a rear wall member, and two side walls;

an opening in the front wall member of the housing for receiving the open top portion of the bag member, the opening facing upwardly and outwardly from the housing;

a vacuum chamber into which a vacuum may be created, the vacuum chamber in communication with a pressure sensor;

a vacuum pump in communication with the vacuum chamber for drawing the vacuum in the vacuum chamber; and wherein the pressure sensor within the appliance continuously monitors pressure within the bag member, and wherein:

the pressure sensor includes a liquid thin setting and a liquid thick setting, each of which correlate to preset pressure sensor measurements;

when the liquid thin setting is activated and a first pressure level is reached, the vacuum pump slows down its pump speed; and when the liquid thick setting is activated and a second pressure level is reached, the vacuum pump stops, and at least one solenoid is opened to reduce pressure in the appliance.

2. The appliance of claim 1, wherein when the bag member is received in the opening, the bag member is substantially upright.

3. The appliance of claim 1, wherein when the pressure sensor senses a decrease in pressure, the vacuum pump at least one of slows down and ceases operating.

4. The appliance of claim 1, wherein the at least one solenoid is in communication with the vacuum pump for relieving pressure.

5. The appliance of claim 1, wherein the appliance includes at least one air piston in communication with the vacuum pump for relieving pressure.

6. The appliance of claim 5, wherein the appliance includes a vacuum release lever in communication with the at least one air piston for actuating the at least one piston.

7. The appliance of claim 1, wherein the appliance also includes a handheld adapter in communication with the vacuum chamber for manual operation.

8. An appliance for vacuum sealing a bag member having a closed bottom portion and an open top portion, the appliance comprising:

a housing including a front wall member, a rear wall member, and two side walls;

an opening in the front wall member of the housing for receiving the open top portion of the bag member;

a vacuum chamber into which a vacuum may be created, the vacuum chamber in communication with a pressure sensor;

a vacuum pump in communication with the vacuum chamber for drawing the vacuum in the vacuum chamber; and wherein the pressure sensor within the appliance continuously monitors pressure within the bag member, and wherein:

the pressure sensor includes a liquid thin setting and a liquid thick setting, each of which correlate to preset pressure sensor measurements;

when the liquid thin setting is activated and a first pressure level is reached, the vacuum pump slows down its pump speed; and when the liquid thick setting is activated and a second pressure level is reached, the vacuum pump stops, and at least one solenoid is opened to reduce pressure in the appliance.

9. The appliance of claim 8, wherein the opening faces upwardly and outwardly from the housing.

10. The appliance of claim 8, wherein when the pressure sensor senses a decrease in pressure, the vacuum pump at least one of slows down and ceases operating.

11. The appliance of claim 8, wherein the at least one solenoid is in communication with the vacuum pump for relieving pressure.

12. The appliance of claim 8, wherein the appliance includes at least one air piston in communication with the vacuum pump for relieving pressure.

13. The appliance of claim 12, wherein the appliance includes a vacuum release lever in communication with the at least one air piston for actuating the at least one piston.

14. The appliance of claim 8, wherein the appliance also includes a handheld adapter in communication with the vacuum chamber for manual operation.

* * * * *